United States Patent [19]

Chang

[11] Patent Number: 4,920,858

[45] Date of Patent: May 1, 1990

[54] NUMERICAL CONTROL APPARATUS FOR A MECHANICAL HYDRAULIC SERVO VALVE

[76] Inventor: Fu-Long Chang, No. 29, Lane 596, Min Sheng S. Rd., Chiayi City, Taiwan

[21] Appl. No.: 292,096

[22] Filed: Dec. 30, 1988

[51] Int. Cl.[5] ..... F15B 9/10

[52] U.S. Cl. ..... 91/380; 91/384; 91/390

[58] Field of Search ..... 91/380, 384, 390

[56] References Cited

U.S. PATENT DOCUMENTS

| | | | |
|---|---|---|---|
| 1,968,656 | 7/1934 | Schmidt | 91/384 X |
| 2,994,304 | 8/1961 | Shulz | 91/380 X |
| 4,369,693 | 1/1983 | Schulze | 91/380 X |

FOREIGN PATENT DOCUMENTS

| | | | |
|---|---|---|---|
| 66182 | 6/1977 | Japan | 91/380 |
| 439631 | 12/1974 | U.S.S.R. | 91/380 |
| 676763 | 7/1979 | U.S.S.R. | 91/380 |

*Primary Examiner*—Robert E. Garrett

*Assistant Examiner*—George Kapsalas

*Attorney, Agent, or Firm*—Willian Brinks Olds Hofer Gilson & Lione

[57] ABSTRACT

A servo system includes a tubular drive shaft journalled in a housing. A screw is engaged threadably with a nut which is fixed in the drive shaft. A driven body is secured to an end of the screw so that the screw can effect a rectilinear movement with the driven body but cannot rotate. A motor can rotate the drive shaft in an infinite angle through a gearing so that the drive shaft can move in a first direction continuously. Then, an end of a fork is rotated by an abuttment element which is sleeved on the drive shaft. At this time, the other end of the fork activates a hydromechanical servo, and hence a hydraulic driving unit, to move the drive body in a second direction which is equal and a opposite the first direction. After which, the drive shaft is moved back to the original position by the driven body. The driven body is therefore moved a predetermined distance. In this way, the driven body can be moved, accelerated, decelerated and stationary in accordance with the input of the specific numerical control signal.

9 Claims, 3 Drawing Sheets

NUMERICAL CONTROL APPARATUS FOR A MECHANICAL HYDRAULIC SERVO VALVE

BACKGROUND OF THE INVENTION

This invention relates generally to a servo system. More particularly, this invention relates to a numerical control apparatus for a mechanical hydraulic servo valve.

A conventional numerical control apparatus for slide mechanism generally includes a ball screw driven by a servo motor or stepping motor. A ball nut carries a slide element thereon and is engaged with the ball screw. The rotation of the ball screw can be converted into the rectilinear movement of the ball nut because of the engagement between the ball screw and the ball nut. This kind of numerical control apparatus suffers from the following disadvantages:

(1) Because a ball screw of a very high precision is needed, it is difficult to make and maintain such a ball screw, resulting in high manufacturing costs. In addition, if the slide element is bulky, a large-size ball screw would be needed, also increasing its manufacturing costs.

(2) When a large-size screw is used, it must be driven by a high horsepower stepping motor or servo motor and the one motor can serve one slide element only. Thus, manufacturing cost is increased further.

(3) Due to uneven load, partial travel, long term serving and sudden impact by error, uncurable irregular worn-out backlash often occurs between the ball screw and the ball nut even when the ball screw and the ball nut are of a high precision.

SUMMARY OF THE INVENTION

It is therefore an object of this invention to provide a reliable numerical control apparatus for industry.

Another object of this invention is to provide an inexpensive numerical control apparatus for industry To these ends the present invention provides, a servo system including a tubular drive shaft journalled in a housing. A screw is engaged threadably with a nut which is fixed in the drive shaft. A driven body is secured to an end of the screw in such a way that rectilinear movement of the the screw can cause rectilinear movement of the driven body but the screw cannot rotate. A motor rotates the drive shaft through a gearing so that the drive shaft moves in a first direction. A fork is then rotated at one end by an abutment element which is sleeved on the drive shaft. The other end of the fork activates a mechanical hydraulic servo, and hence a hydraulic driving unit, to move the driven body in a second direction which is opposite the first direction. The drive shaft is then moved back to the original position by the driven body. In this system, the assembly of ball screw and nut is used as a measuring and controlling unit. As a result, the backlash between the ball screw and the nut is minimized. Because the force applied to the ball screw and nut is even and small, the wear between the ball screw and nut is reduced. Furthermore, a low horsepower motor can be used to driven the ball screw.

In addition, the driven body can be easily driven by a hydraulic driving unit and a plurality of driven bodies can be driven by a single hydraulic driving unit.

BRIEF DESCRIPTION OF THE DRAWINGS

Other features and advantages of this invention will become apparatus in the following detailed description of a preferred embodiment of this invention with reference to the accompanying drawings in which.

DETAILED DESCRIPTION OF THE PREFERRED EMBODIMENT

Figure 1:
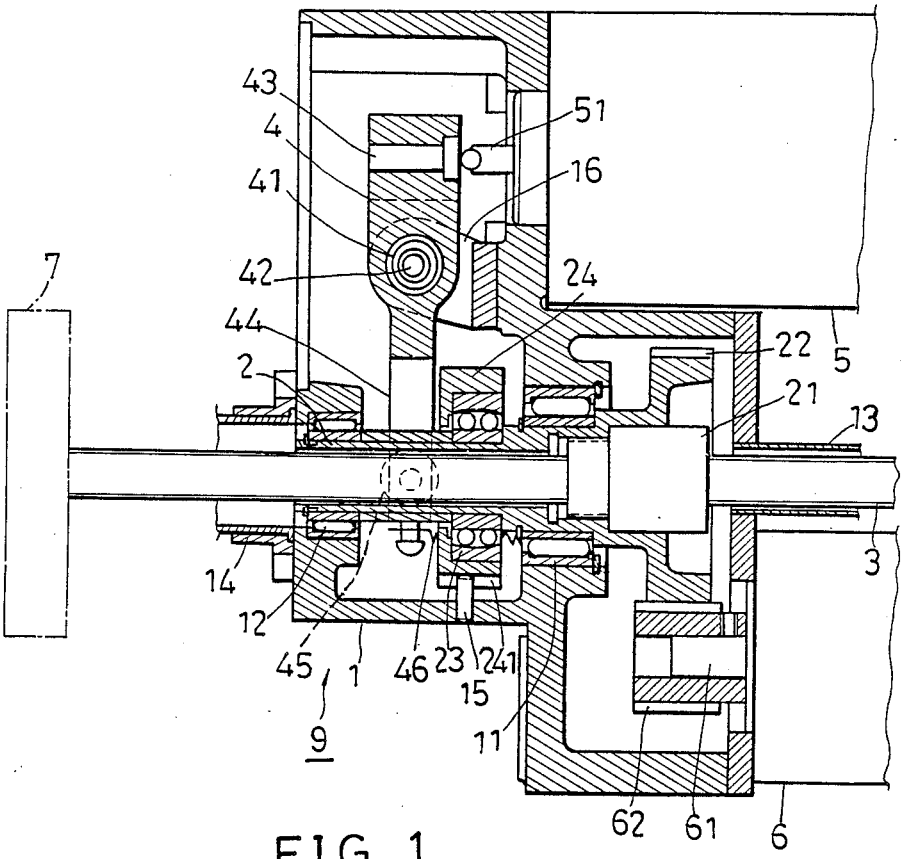
FIG. 1 is a sectional view of a numerical control apparatus according to this invention.
Figure 2:
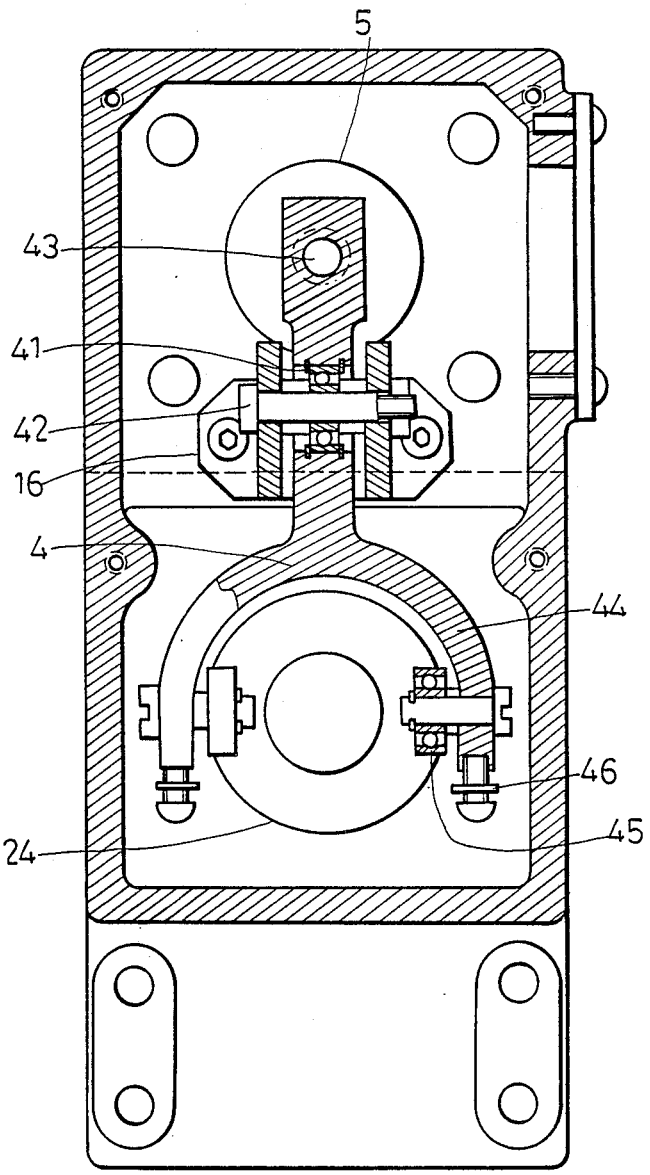
FIG. 2 is a schematic view illustrating the fork of the numerical control apparatus according to this invention.

Referring to FIGS. 1 and 2, the numerical control apparatus 9 of this invention includes a housing 1, a tubular drive shaft 2, a screw 3, and a fork 4.

A mechanical hydraulic servo valve 5 and a motor 6 are attached to the housing 1. The motor 6 may be either a stepping motor or servo motor. The motor 6 has a motor shaft 61 is integral with an active gear 62. The drive shaft 2 is journalled in the housing 1 by roller bearings 11, 12 and thus the drive shaft 2 can move axially. A nut 21 is fixed in the drive shaft 2. A reactive gear 22 is integral with the drive shaft 2 and meshes with the active gear 62 so that the drive shaft 2 can be rotated by the motor 6. An annular abutment element 24 is sleeved rotatably on the drive shaft 2 by a gearing 23 and has an axially extending keyway 241 into which a key 15 is inserted. The key 15 is fixed in the housing 1 so as to prevent the rotation of the abutment element 24.

The screw 3 extends through the drive shaft 2 and is engaged threadably with the nut 21. Because a driven body 7, such as a slidable machine table, is secured to the left end of the screw 3, said screw 3 can effect an axial rectilinear movement of the driven body but cannot itself rotate.

The fork 4 is connected rotatably to a pivot pin 42 by a bearing 41 at an intermediate portion of the fork 4 thereof. The pivot pin 42 is fixed on a support frame 16 which is fixed in the housing 1. A wear pad 43 is secured to the upper end of the fork 4. The servo valve 5 includes a spool 51 disposed therein. The spool 51 is pushed by a spring (not shown) to abut against the wear pad 43. Referring to FIG. 2, the fork blades 44 of the fork 4 ride on the drive shaft 2 and are pulled by a tension spring 46 so as to bring the abutment element 24 into contact with two bearings 45 which are respectively mounted on the lower end portions of the fork blades 44.

Figure 3:
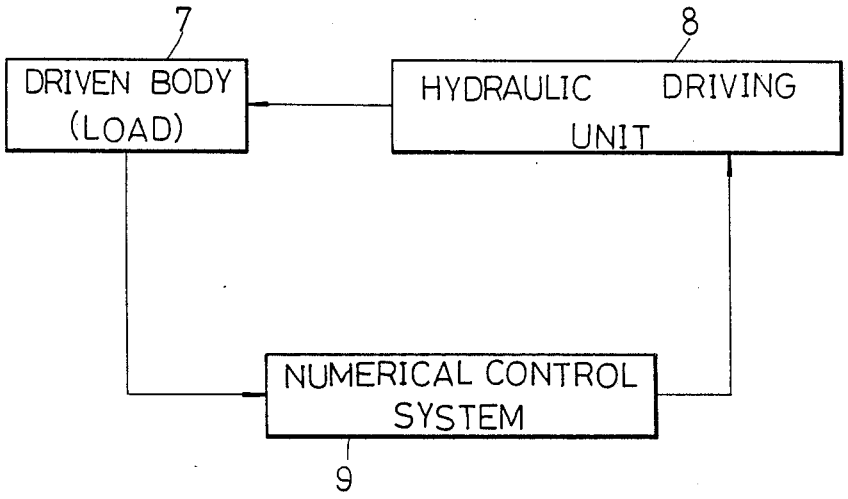
FIG. 3 is a block diagram of a servo system using the numerical control apparatus of this invention.
Figure 4:
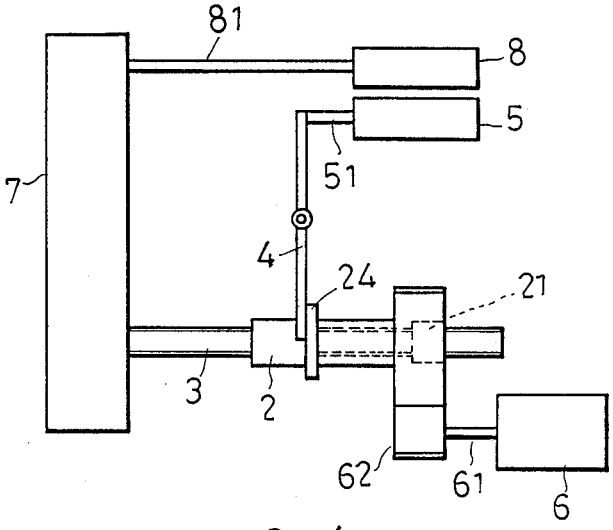
FIG. 4 is a schematic view of the servo system using the numerical control apparatus of this invention.

When the motor 6 rotates the drive shaft 2 through the active gear 62 and the reactive gear 22, the drive shaft 2 moves a predetermined distance in a first direction due to the fact that the screw 3 cannot rotate and is engaged with the nut 21. Because the fork blades 44 of the fork 4 are pulled by the tension spring 46 so that they continually rest against the abutment element 24, the fork 4 rotates to cause the spool 51 of the servo valve 5 to move in a second direction which is opposite the first direction. Then, the servo valve 5 activates the piston rod 81 of a hydraulic cylinder 8 (see FIGS. 3 and 4) to move the driven body 7, the screw 3 and the drive shaft 2 the predetermined distance in the second direction. The fork 4 and the servo valve 5 thus return to their original positions, achieving an automatic feedback control. When the servo valve 5 returns to the original position, it no longer activates the hydraulic cylinder 8.

Because the key 15 engages with the keyway 241 of the abutment element 24 and the bearing 23 is disposed between the drive shaft 2 and the abutment element 24, when the shaft 2 rotates, the abutment element 24 cannot rotate allowing the abutment element 24 to contact firmly with the fork blades 44. Furthermore, because the bearings 45 are provided on the lower end portions of the fork blades 44, when the fork 4 rotates, a rolling friction is created between the abutment element 24 and said fork blades 44.

In a situation where the motor 6 is idle, when the driven body 7 is moved by an external force, the screw 3, drive shaft 2, fork 4, servo valve 5 and hydraulic cylinder 5 are in turn activated until the driven body 7 returns to its original position. A centering effect is therefore obtained in accordance with this invention. That is to say, the driven body 7 can be automatically and accurately positioned.

The hydraulic cylinder 8 may be replaced with a cylinder, motor, rotary actuator, turbine, or other hydraulic driving unit. The motor 6 may be replaced with any suitable manual rotary driving source.

While the invention has been disclosed with reference to a preferred embodiment, it is apparent that numerous modifications and variations can be made without departing from the scope and the spirit of this invention. It is therefore intended that this invention be limited only as indicated in the appended claims.

I claim:

1. A servo system comprising:

a housing;

a rotary driving source having a rotating shaft;

an active gear integral with said rotating shaft of said rotary driving source;

a tubular drive shaft journalled in said housing and movable axially relative to said housing;

a reactive gear integral with said drive shaft and meshing with said active gear so that said rotary driving source can rotate said drive shaft;

a nut fixed in said drive shaft;

a screw extending through said drive shaft and engaged threadably with said nut;

a driven body secured to an end of said screw so that it can move with said screw, both said driven body and said screw being unable to rotate;

a fork mounted pivotally in said housing at an intermediate portion thereof and having a first end;

a biasing means for biasing said first end of said fork to rest against said drive shaft in a manner which enables said first end of said fork to be rotated by said drive shaft when said drive shaft moves;

a mechanical hydraulic servo valve operatively connected to the other end of said fork;

a hydraulic driving unit interconnecting said servo valve and said driven body for hydraulically moving said driven body when said servo valve is activated by said fork;

whereby, when said drive shaft is rotated by said rotary driving source to effect a rectilinear axial movement in a certain direction, said fork is rotated to activate said servo valve so that said driven body, said screw and said drive shaft are moved in the opposite direction by said hydraulic driving unit.

2. A servo system as claimed in claim 1, wherein said rotary driving source is a stepping motor.

3. A servo system as claimed in claim 1, wherein said rotary driving source is a servo motor.

4. A servo system as claimed in claim 1, wherein said drive shaft includes an annular abuttment element, said first end of said fork includes an auxiliary bearing mounted thereon and contacting said abutment element for creating a rolling friction between said fork and said abutment element, whereby, said fork can contact firmly with said abutment element.

5. A servo system comprising:

a housing;

a rotary driving source having a rotating shaft, said drive shaft including a first bearing, and an annular abutment element sleeved rotatably on said drive shaft by said first bearing and having a keyway formed in said abutment element, and wherein said housing includes a key fixed therein and engaged with said keyway for preventing relative rotation between said abutment element and said housing while permitting relative movement between said abutment element and said housing;

an active gear integral with said rotating shaft of said rotary driving source;

a tubular drive shaft journaled in said housing and movable axially relative to said housing;

a reactive gear integral with said drive shaft and meshing with said active gear so that said rotary driving source can rotate said drive shaft;

a nut fixed in said drive shaft;

a screw extending through said drive shaft and engaged threadably with said nut;

a driven body secured to an end of said screw so that it can move with said screw, both said driven body and said screw being unable to rotate;

a fork mounted pivotally in said housing at an intermediate portion thereof and having a first end;

a biasing means for biasing said first end of said fork to rest against said drive shaft in a manner which enables said first end of said fork to be rotated by said drive shaft when said drive shaft moves;

a mechanical hydraulic servo valve operatively connected to the other end of said fork;

a hydraulic driving unit interconnecting said servo valve and said driven body for hydraulically moving said driven body when said servo valve is activated by said fork;

whereby, when said drive shaft is rotated by said rotary driving source to effect a rectilinear axial movement in a certain direction, said fork is rotated to activate said servo valve so that said driven body, said screw and said drive shaft are moved in the opposite direction by said hydraulic driving unit.

6. A servo system as claimed in claim 5, wherein said biasing means includes a tension spring which interconnects said first end of said fork and a portion of said housing, said abutment element being positioned between said fork and said portion of said housing, whereby, said tension spring can bias said first end of said fork to rest against said abutment element in a manner which enables said first end of said fork to be rotated by said abutment element when said drive shaft moves.

7. A servo system as claimed in claim 5, wherein said rotary driving source is a stepping motor.

8. A servo system as claimed in claim 5, wherein said rotary driving source is a servo motor.

9. A servo system as claimed in claim 5, wherein said first end of said fork includes an auxiliary bearing mounted thereon and contacting said abutment element for creating a rolling friction between said fork and said abutment element, whereby, said fork can contact firmly with said abutment element.

* * * * *